US005615767A

United States Patent [19]

Eull et al.

[11] Patent Number: 5,615,767

[45] Date of Patent: Apr. 1, 1997

[54] METHOD AND PACKAGING FOR SURGICAL MASKS

[75] Inventors: Patricia A. Eull, Mahtomedi, Minn.; Todd R. Berger, Hudson, Wis.; Joel S. Graf, Vadnais Heights, Minn.

[73] Assignee: Minnesota Mining and Manufacturing Company, St. Paul, Minn.

[21] Appl. No.: 420,111

[22] Filed: Apr. 11, 1995

[51] Int. Cl.[6] ..... B65D 85/18

[52] U.S. Cl. ..... 206/278; 206/499

[58] Field of Search ..... 206/449, 438, 206/440, 441, 363, 213, 499, 278, 8; 128/206.12, 206.19, 206.23, 206.27; 2/9; 53/443, 446, 447, 531

[56] References Cited

U.S. PATENT DOCUMENTS

| | | | |
|---|---|---|---|
| Re. 28,102 | 8/1974 | Mayhew | 128/146.2 |
| 1,123,470 | 1/1915 | Betten | 206/440 |
| 1,688,983 | 10/1928 | O'Keeffe | 206/499 |
| 2,056,753 | 10/1936 | Wagner . | |
| 2,762,368 | 9/1956 | Bloomfield | 128/146 |
| 3,119,492 | 1/1964 | Burket | 206/455 |
| 3,446,842 | 7/1969 | Mierson | 221/33 |
| 3,834,384 | 9/1974 | Raines | 128/146.2 |
| 3,881,632 | 5/1975 | Early et al. . | |
| 3,924,871 | 12/1975 | Mesenbring | 206/597 X |
| 4,235,638 | 11/1980 | Beck et al. | 106/287.12 |
| 4,269,315 | 5/1981 | Boyce | 206/438 |
| 4,375,848 | 3/1983 | Simpson et al. . | |
| 4,419,993 | 12/1983 | Petersen | 128/201.15 |
| 4,459,127 | 7/1984 | Kunzel | 493/69 |
| 4,673,084 | 6/1987 | Hubbard et al. . | |
| 4,674,635 | 6/1987 | Huldin et al. | 206/555 |
| 4,714,643 | 12/1987 | Krenzel | 428/131 |
| 4,796,621 | 1/1989 | Barle et al. | 128/206.23 |
| 4,797,956 | 1/1989 | Boyce | 2/431 |
| 4,816,333 | 3/1989 | Lange et al. | 428/331 |
| 4,821,340 | 4/1989 | Johnson | 2/9 |
| 4,825,878 | 5/1989 | Kuntz et al. | 128/857 |
| 4,920,960 | 5/1990 | Hubbard et al. | 128/206.12 |
| 4,944,294 | 7/1990 | Borek, Jr. | 128/206.19 |
| 4,969,457 | 11/1990 | Hubbard et al. | 128/206.12 |
| 5,020,533 | 6/1991 | Hubbard et al. | 128/206.23 |
| 5,150,703 | 9/1992 | Hubbard et al. | 128/206.12 |
| 5,165,570 | 11/1992 | Windorski et al. | 221/46 |

FOREIGN PATENT DOCUMENTS

| | | | |
|---|---|---|---|
| WO89/10106 | 2/1989 | WIPO | A61F 9/04 |

*Primary Examiner*—Jacob K. Ackun

*Attorney, Agent, or Firm*—Gary L. Griswold; Walter N. Kirn; Stephen W. Bauer

[57] ABSTRACT

A package for holding and dispensing surgical masks, respirators, face shields and other articles having eye shields made from a substantially transparent, flexible material susceptible to abrasion or scratching. The surgical masks are stacked within the container one upon another and a fanning force is applied to each eye shield such that the eye shields become semi-rigid and fan apart, one from the next in the stack. In such condition scratching caused by the eye shields rubbing against each other is virtually eliminated, and the surgical masks are dispensed in a convenient scratch-free manner.

22 Claims, 3 Drawing Sheets

METHOD AND PACKAGING FOR SURGICAL MASKS

TECHNICAL FILED

This invention relates to specialty packaging adapted for protecting surgical masks, respirators, face shields and other articles having a transparent eye shield portion that is susceptible to abrasion.

BACKGROUND OF THE INVENTION

In modern medicine, much importance is naturally placed on preventing the spread of infection to medical practitioners through contact with the body fluids of patients. Surgical masks to protect the nose and mouth of the wearer have long been used for this purpose. Surgical mask constructions generally are discussed in U.S. Pat. Nos. 4,419,993 (Petersen); 4,969,457 (Hubbard et al.); 4,920,960 (Hubbard et al.); 3,834,384 (Raines); and Reissue. 28,102 (Mayhew). More recently improvements to such surgical masks have included the provision of transparent thermoplastic film eye shields attached to the mask for protecting the wearer's eyes as well. For example, U.S. Pat. Nos. 4,944,294 (Borek, Jr.); U.S. Pat. Nos. 5,020,533 and 5,150,703 (Hubbard et al); and PCT Application PCT/US89/01629 (Russell) disclose face masks with visors or eye shields attached to the masks.

However, a problem arises in connection with such masks with eye shields, namely the difficulty of packaging them for distribution to the end user. The transparent polymeric material of the eye shields, and especially some optical coatings which might be applied to them to enhance the wearer's vision, can be highly vulnerable to abrasion during shipping and handling. Abrasion to the eye shield portion of the mask compromises clear vision, which is essential to the health care practitioner. Known methods of packaging surgical masks, such as are disclosed in U.S. Pat. No 4,269,315 (Boyce), entitled "METHOD AND APPARATUS FOR PACKAGING STERILE SURGICAL MASKS," would not protect the transparent film of an attached eye shield. There is a need for an inexpensive package which will protect the eye shields from abrasion during shipping and handling and permit the ready dispensing of the surgical masks.

SUMMARY OF THE INVENTION

The present invention ameliorates the limitations of the prior art by providing a package which supports a stack of surgical masks, respirators, face shields, or eye shields in such a way that their transparent, abrasion sensitive, eye shield portions are arrayed apart one from another. In broad terms the invention can be considered as a method of packaging and dispensing articles having eye shields made from a substantially transparent, abrasion sensitive, flexible material, by providing a container, stacking the articles within the container and applying a fanning force to each eye shield within the container such that the eye shields are held in a semi-rigid condition. Preferably, the packaging container has a raised central portion extending within the package from its bottom, and the articles are stacked within the container one upon another over the raised portion such that the flexible eye shields are held in a bent, semi-rigid condition. When standard surgical masks with eye shields are supported thusly, the multi-layered material used in the lower portion of the surgical mask to cover the nose and mouth of the wearer can act as a natural spacer, separating the attached eye shields one from another so that they will not abrade each other during shipping and handling. Where eye shields are packaged without attached face masks, spacers are preferably used at least between one edge of the shields to separate them. Applying a force to the eye shield portion to hold the flexible shield in a semi-rigid condition makes it less susceptible to random movement if vibrated, such as during shipping. This reduced movement in combination with the spacing of the shields virtually eliminates abrasion caused by the shields rubbing against each other, or against the face mask material or the package.

In preferred embodiments, the raised central portion of the container is in the form of an arc or hump extending within the packaging container from its bottom. In cases where the article packaged includes a face mask of the sort having tie strings and/or ear loops, it may be advantageous that the raised central portion contains cut-outs adapted to position the tie strings or ear loops underneath the raised portions, so as to prevent the tie strings from abrading the eye shields and permit each mask to be withdrawn in turn from the box without entangling the tie strings of other masks.

Another way of looking at the invention is that it is a package comprising a container and a stack of articles having eye shields made from a flexible, transparent, abrasion-sensitive material positioned within the container. A fanning force is applied to each eye shield such that they are held in a semi-rigid, fanned condition. In such a condition, they tend not to rub up against each other. Preferably the package container includes a bottom with a raised central portion and the articles are stacked within the container one upon another such that they are supported at the central portion of the eye shield by the raised central portion of the container, thereby holding the eye shields in a semi-rigid, bent condition.

An advantage of the invention is that it is very cost-effective compared with other expedients such as packaging each transparent eye shield or face mask individually.

Surgical masks currently on the market require health care professionals to prebend the mask at about the center of each mask prior to application in order to adequately fit the mask to the wearer's face. Thus, a further advantage of the preferred embodiment of the present invention is that the surgical masks are supplied in a prebent condition which facilitates application of the mask to the wearer's face.

DETAILED DESCRIPTION OF THE INVENTION

Figure 1:
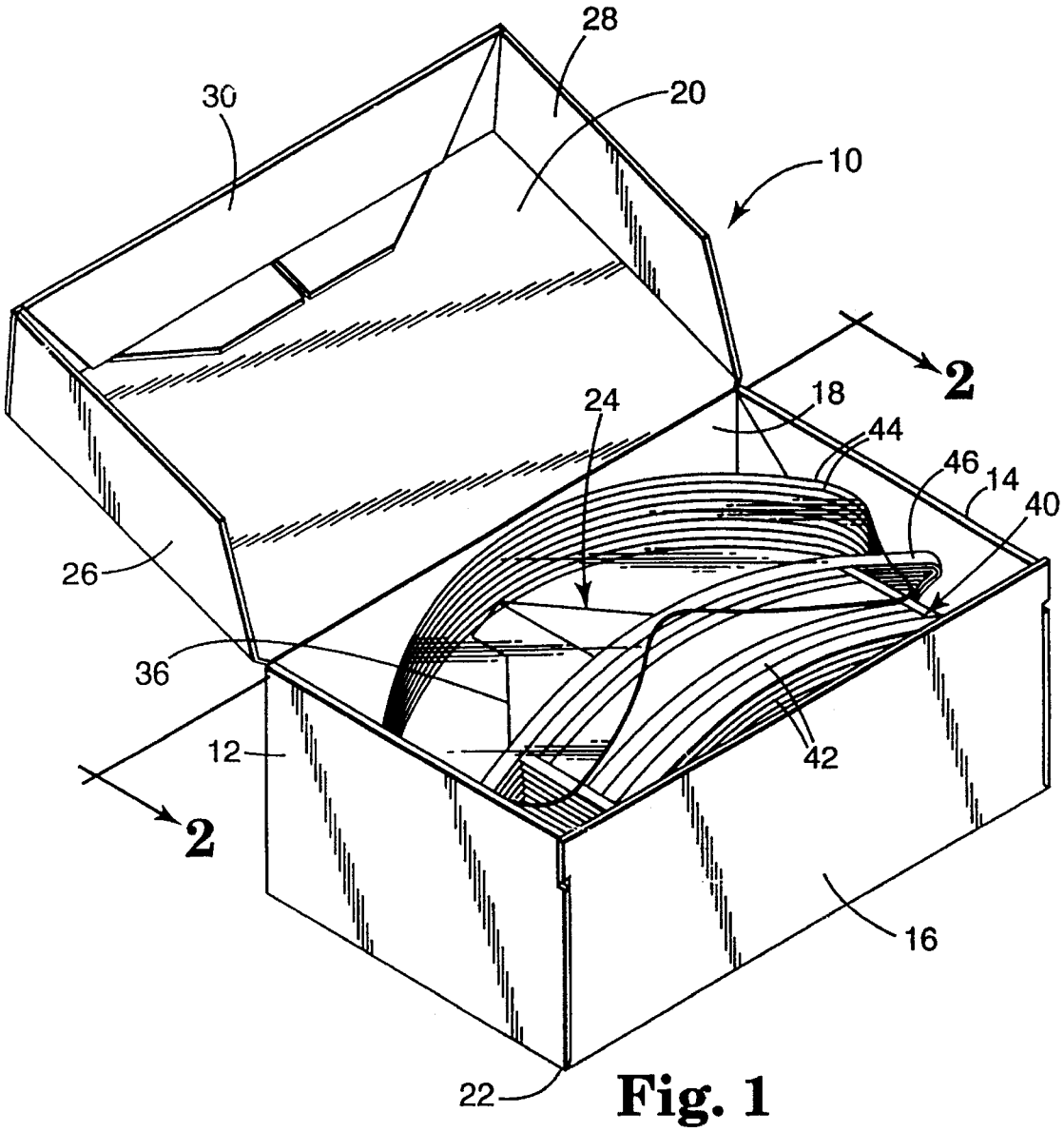
FIG. 1 is a perspective view of an exemplary package suitable for use in the present invention, with a stack of surgical masks disposed therein.
Figure 2:
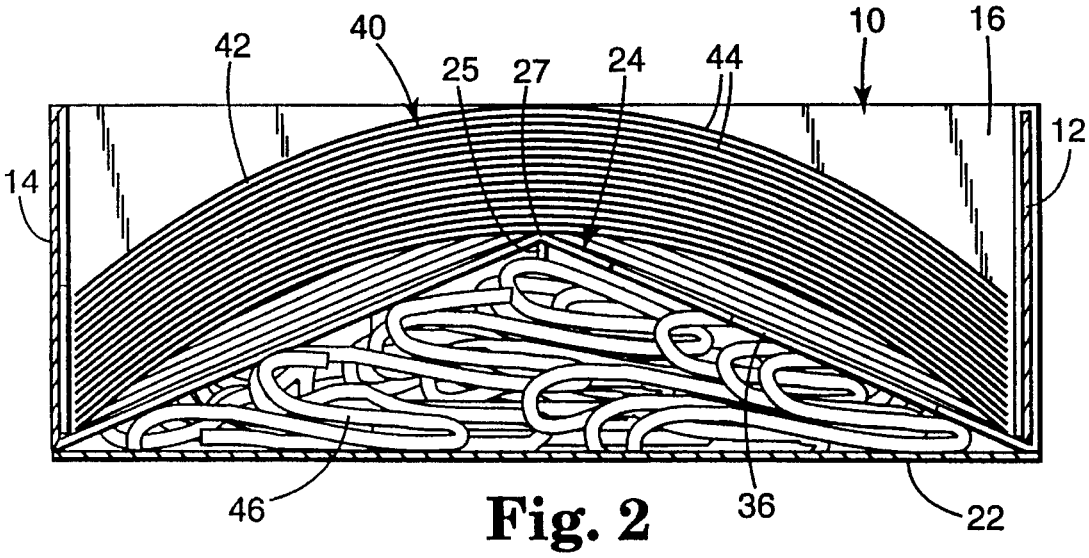
FIG. 2 is a cross-sectional view of the package of FIG. 1, taken along section lines 2—2.

Referring to FIGS. 1 and 2, an exemplary container 10 suitable for use with the present invention is illustrated. The container 10 includes opposing side walls 12 and 14, from panel 16, opposing back panel 18, top 20, bottom 22 (out of view), and raised portion 24. The top 20 has opposing side coveting portions 26 and 28, and a from coveting portion 30 adapted to overlie, side walls 12 and 14, and front panel 16, respectively, when the top 20 is lowered to close the container. To accommodate a stack of about 25 standard sized face masks, the container will normally have dimensions of about 280 mm long, 180 mm wide and 100 mm deep. A removed portion 36 in the raised portion 24 allows the container to conveniently be formed from a single blank of corrugated board, as will be appreciated in connection with FIG. 4.

FIGS. 1 and 2 show the container 10 with a stack of surgical masks 40 disposed therein. Each of the surgical masks 40 has a mask portion 42 formed of conventional surgical mask material, most preferably a multi-layered material, which is permeable to air. Optionally, the mask portion 40 includes a pliable metal insert (not shown) along the side adapted to lie over the bridge of the nose, as shown in U.S. Pat. No. 4,944,294, incorporated herein by reference. When bent to follow the contours of the bridge of the nose, the metal strip helps hold the mask snugly on the wearer's face.

Attached to the mask portion 42 is an eye shield 44 formed of a substantially transparent, flexible material. Suitable materials include polyester, acrylics, polycarbonate, polystyrene and the like. Preferably the polymeric film from which the eye shield 44 is formed is about 0.05 to 0.25 mm thick, most preferably 0.1 mm thick, to provide the shield with the desired flexibility. By "flexible" it is meant that the material from which the eye shield 44 is made has a modulus of elasticity of about 400 to 7,000 MPa, preferably about 1,200 to 5,000 MPa, and most preferably about 1,350 to 3,500 MPa.

In preferred embodiments, the eye shield 44 may be coated with a layer or layers imparting anti-reflective or anti-fogging properties, such as those described in co-pending, commonly assigned U.S. patent application Ser. Nos. 08/354,242 and 08/354,343, filed Dec. 12, 1994, both of which are entitled "COATING COMPOSITION HAVING ANTI-REFLECTIVE AND ANTI-FOGGING PROPERTIES," and both of which are incorporated herein by reference. The anti-reflective coating is preferably provided by a porous inorganic metal oxide as described in U.S. Pat. No. 4,816,333, incorporated herein by reference. The anti-fog property is preferably provided by a silane or siloxane oligomer having at least one hydrophilic anionic group and/or a perfluoroaliphatic anionic salt. Particularly preferred sulfonato-organosilanols are disclosed in U.S. Pat. No. 4,235,638, incorporated herein by reference. Preferred salts of anionic perfluoroaliphatic radical containing compounds include lithium, potassium and ammonium salts of anionic perfluoroaliphatic radical containing compounds. Examples of commercially available lithium salts of anionic perfluoroaliphatic radical containing compounds include "Fluorad™ FC-122," "Fluorad™ FC-123" and "Fluorad™ FC-124 Fluorochemical Surfactants," from 3M Company, St. Paul, Minn. Examples of commercially available potassium salts include "Fluorad98 FC-127," "Fluorad™FC-129" and "Fluorad™FC-95 Fluorochemical Surfactant," from 3M. A useful ammonium salt is commercially available as "Fluorad™FC-120 Fluorochemical Surfactant" from 3M.

The surgical masks 40 will have some means for holding the mask on the face of the wearer; this is conveniently a pair of tie strings 46 on each side of the surgical mask. Other means of securing the mask on the face of the wearer include ear loops, elastic bands, or mechanical fasteners.

Referring now to FIG. 2, a cross-section view of the container 10 with its stack of surgical masks 40 depicted in FIG. 1, taken along section lines 2—2, is illustrated. It will now be more readily appreciated how the surgical masks 40 are supported in a bent, semi-rigid condition within container 10. The raised portion 24 is preferably in the shape of an inverted V. The raised portion 24 is supported at its apex 27 by support 25 which extends from the apex 27 of the raised portion 24 to the bottom 22 of the container. This support 25 prevents the raised portion 24 from collapsing, particularly under loads experienced during shipping.

The eye shields 44 are held in a semi-rigid bent condition within the container 10 by first pre-bending the shields 44 at their center and positioning the shields over raised portion 24. The stack of shields 44 are held in a bent condition within the container 10 by the bent metal strip of the mask portion 40 in combination with the side Walls 12 and 14 of the container which press up against the adjacent sides of the eye shields 44. The force applied to the shields is sufficient to cause the shields to become semi-rigid and fan such that they are held apart, one from the next in the stack. Normally the flexible eye shield 44 will stiffen and fan when bent by at least about 10 °, preferably by about 20° to 45°. To provide such a bend to the eye shield 44, the raised portion 24 is at least about 12 mm, normally about 70 mm, above the bottom 22 of the container 10 at its apex. While the shields 44 in the drawings are caused to fan by bending, it is appreciated that it is not required that the shields be bent to cause them to fan apart. For example, each shield 44 in the stack could be held with sufficient force, for example, at each of their side edges, to cause them to become semi-rigid and fan apart without actually bending the shields.

Additionally, while the shields depicted in the drawings are held horizontally within the container, they could be positioned vertically, in a preferably bent condition.

The surgical mask material used in the mask portion 42 of the surgical mask 40 acts as a natural spacer, thus enabling the flexible eye shields 44 connected to these mask portions 42 to be held separated one from another so that they will not scratch each other during shipping and handling.

FIG. 2 shows surgical masks 40 arranged such that the eye shields 44 all face the same direction. However, the masks 40 may be placed in the container 10 in any arrangement as long as a farming force is applied to the eye shields 44 which renders the eye shields substantially semi-rigid, and the abrasion sensitive eye shields are positioned so they do not contact each other or any other facets of the surgical masks or package. Other suitable arrangements include alternating the direction of each mask 40 in the slack such that each eye shield 44 is adjacent the lower portion 42 of the next mask. Preferably, however, all masks 40 are stacked with the shields in one direction to facilitate easy removal.

Figure 3:
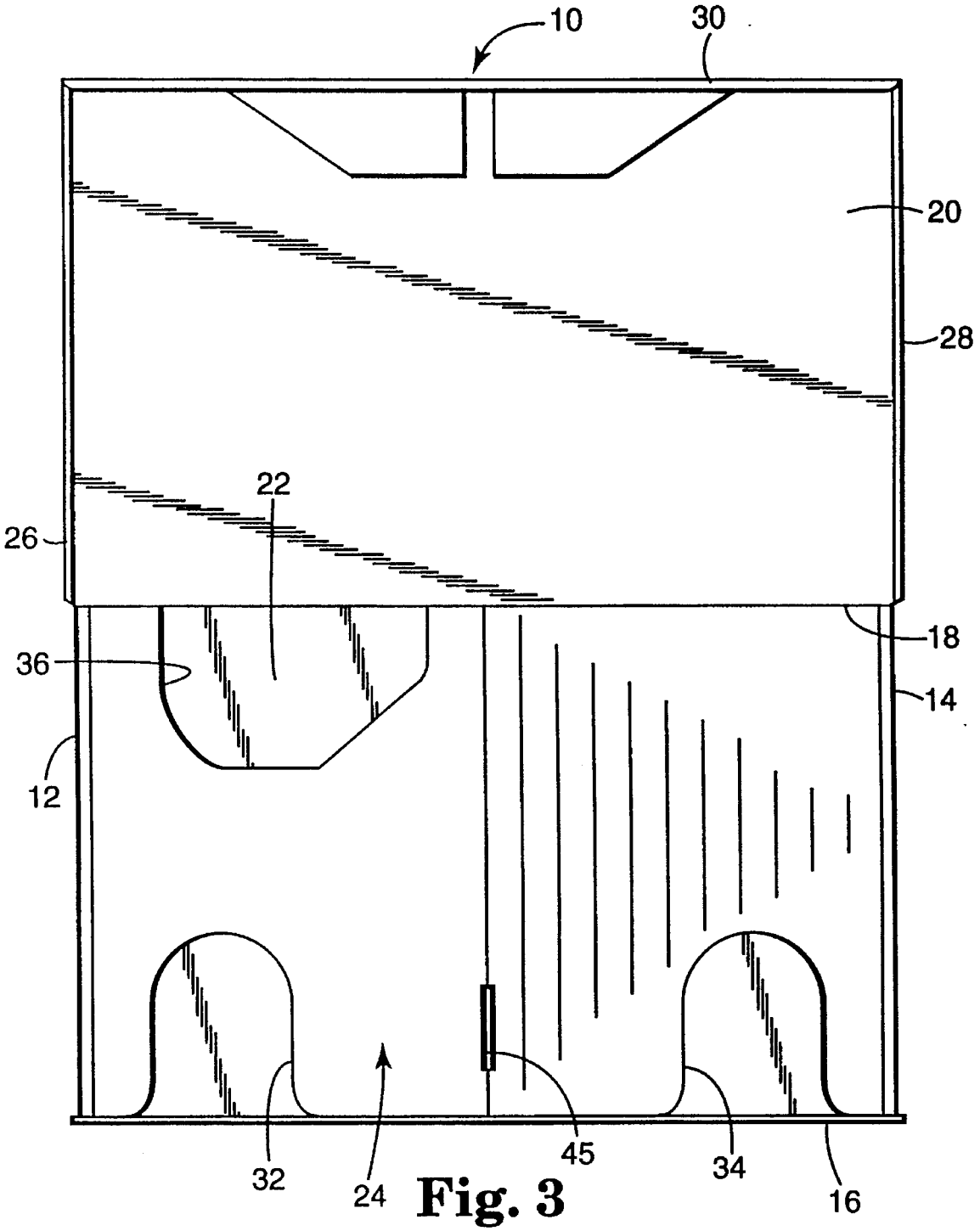
FIG. 3 is a top view of the container of FIG. 1, with the surgical masks removed.

Referring now to FIG. 3, it will be appreciated that cut-out portions 32 and 34 in raised portion 24 permit the trailing ends of tie strings 46 to be draped through so they will be stored below the raised portion 24 during shipping (as best shown is FIG. 2). This facilitates the withdrawal of each surgical mask 40 in turn from the container 10 without entangling other masks, and the forces applied by holding the tie strings 46 under the raised portion 24 help to hold the eye shield 44 in a bent semi-rigid condition over the raised portion 24. Storing the tie strings 46 underneath the raised portion 24 also prevents the strings from abrading the eye shields 44.

Raised portion 24 also includes a slot 45 which is shaped and adapted to receive the tab 47 which extends from support 25. This insures that support 25 remains in place during use and shipping.

Figure 4:
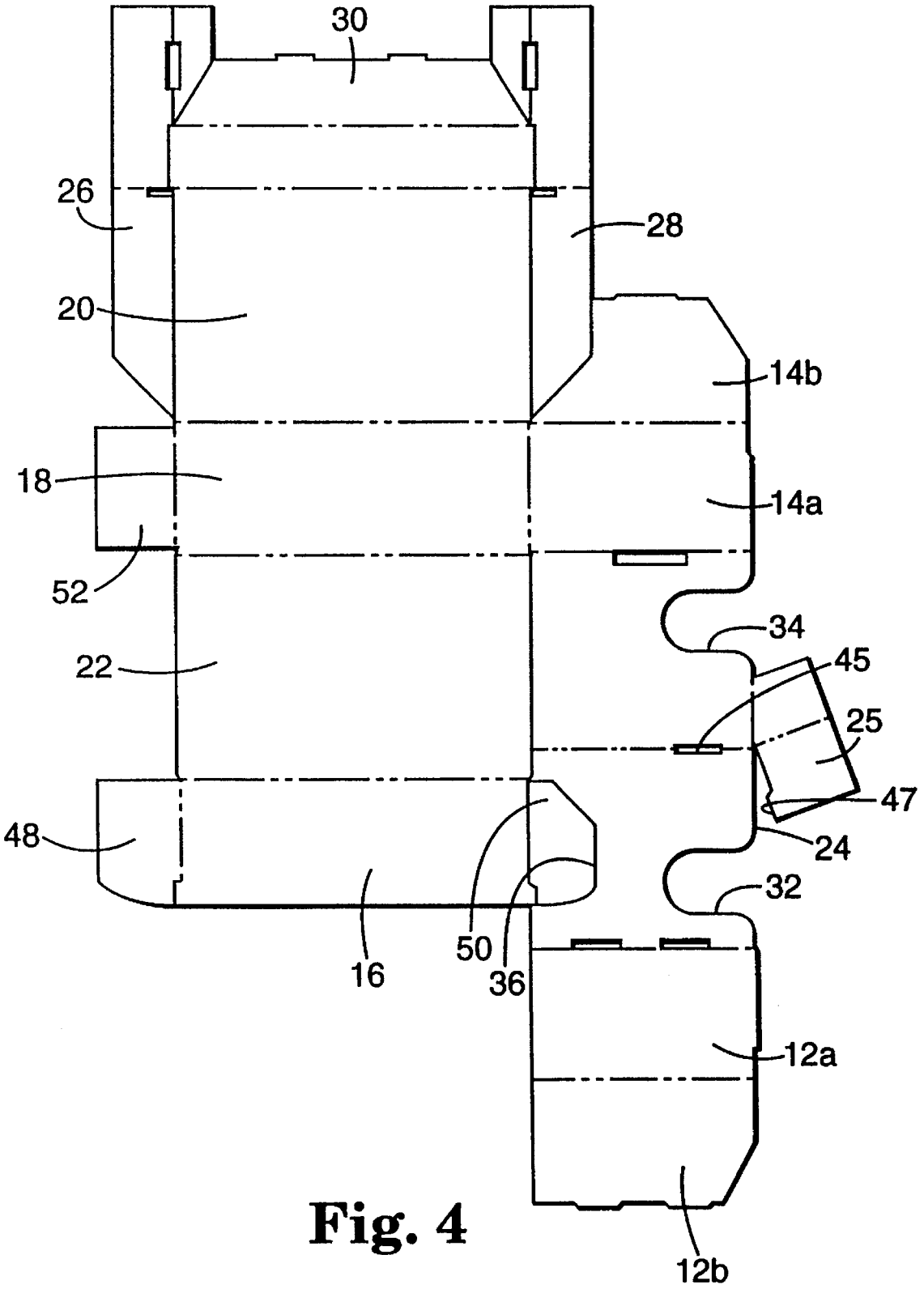
FIG. 4 is a plan view of a die cutting plan suitable for cutting a cardboard blank into a shape readily assembled into the container of FIG. 3.

Referring now to FIG. 4, a plan view of a die cutting plan suitable for cutting a cardboard blank into a shape which can be readily assembled into a preferred container 10 is depicted In this view it can more readily be appreciated how removed portion 36 aids in allowing the container 10 to be formed from a single blank. It will also be appreciated that side walls 12 and 14 are conveniently formed as a double layer from wall portions 12*a* and 12*b*, and 14*a* and 14*b* respectively. An aspect of the assembly of the cut blank into container 10 is then the insertion of tab 52 into the slot between wall portions 12*a* and 12*b*. The benefit of this construction is that when the container 10 is assembled thusly, cut-out portions 32 and 34 lie exposed forwards. A stack of surgical masks 40 can be taken with both hands by the assembly operator, holding the tie strings 46 on each side of the mask 40 in each hand. The stack of masks is prebent slightly at its center. The stack of surgical masks 40 is then readily inserted through the front of the container 10, sliding the main part of the masks above raised portion 24, but sliding the bundles of the trailing ends of tie strings 46 into cut-out portions 32 and 34 so that they lie below raised portion 24. Support 25 is folded underneath raised portion 24 and its tab 47 is inserted into slot 45. The front panel 16 is then raised into place and held by tabs 48 and 50 which are inserted into the slots between wall portions 12*a* and 12*b*, and 14*a* and 14*b*, respectively. Top 20 is lowered into the rest of the container to complete the packaging.

The package of the present invention ensures that the eye shields stacked within the container do not abrade one another. It is also important that the top and bottom eye shields in the stack (which may be in contact with the inner surfaces of the container 10, such as raised portion 24 and top 20) not be abraded or contaminated. It has been found that certain materials can result in abrasion an/or partial or total elimination of the anti-fog properties of the preferred anti-fog/anti-reflective shields disclosed in co-pending, commonly assigned U.S. patent application Ser. Nos. 08/345,242 and 08/354,343. Therefore, the materials used to form container 10 should be comprised of materials which do not abrade or contaminate the shields. Currently preferred materials for constructing container 10 include cardboard, clay coated solid white bleached sulfate boxboard, and laminates of these with polyester, high density polyethylene, or polystyrene. The most preferred material is a laminate comprised of cardboard and polyester film, wherein the polyester film is in contact with the eye shield product. This construction has been found to result in essentially no loss in the anti-fog property while providing a surface that minimizes or eliminates abrasion. It may also be possible to provide a top and bottom sheet of the preferred materials of construction rather than a laminate, e.g., placing a polyester film sheet in the top and bottom of the box.

As various changes could be made in the above constructions and methods without departing from the scope of the invention, it is intended that all matter contained in the above description be interpreted as illustrative and not in a limiting sense. For example, the packaging of surgical face shields, which have a foam strip or pad attached to the transparent, flexible shield and intended to rest against the forehead of a wearer is also considered to be within the scope of the invention.

I claim:

1. A method of packaging and dispensing a plurality of face shields each comprising a flexible, substantially transparent, abrasion sensitive eye shield portions, the method comprising the steps of:

providing a container having a bottom comprising a raised central portion with an apex along a line parallel to a minor axis of the container;

stacking the face shields within the container such that the eye shield portions are in a bent configuration over the raised central portion of the container; and applying a fanning force to the plurality of face shields such that the eye shield portions are held in a semi-rigid, separated condition so that abrasion of the eye shield portions is minimized.

2. The method of claim 1 wherein the raised central portion comprises an inverted V.

3. The method of claim 1 wherein the face shield comprises a surgical face mask material attached to the eye shield portion.

4. The method of claim 3 wherein the face shield further comprises attachment means attached thereto adapted to position the face shield around the head of a wearer, and further wherein the raised central portion comprises a cut-out adapted to position the attachment means below the raised central portion.

5. The method of claim 4 wherein the attachment means are selected from a group comprising tie strings, elastic bands or ear loops.

6. A method of packaging and dispensing a plurality of face shields each comprising a flexible, substantially transparent, abrasion-sensitive eye shield portions, the method comprising the steps of:

providing a container having a major and a minor axis and a bottom comprising a raised central portion with an apex along a line parallel to a minor axis of the container; and stacking the face shields within the container so that the eye shield portions are in a bent configuration over the raised central portion of the container such that the eye shield portions are held in a semi-rigid, separated condition so that abrasion of the eye shield portions is minimized.

7. The method of claim 6 wherein side walls of the container apply a compressive force to maintain the eye shield portions in the bent configuration.

8. The method of claim 6 wherein the raised central portion comprises an inverted V.

9. The method of claim 6 wherein the face shield comprises a surgical face mask material attached to the eye shield portion.

10. The method of claim 9 wherein the face shield further comprises attachment means attached thereto adapted to position the face shield around the head of a wearer, and further wherein the raised central portion comprises a cut-out adapted to position the attachment means below the raised central portion.

11. The method of claim 10 wherein the attachment means are selected from a group comprising tie strings, elastic bands or ear loops.

12. A package for retaining and dispensing a plurality of face shields each comprising a flexible, substantially transparent, abrasion-sensitive eye shield portions, the package comprising:

a container having a bottom comprising a raised central portion with an apex along a line parallel to a minor axis of the container;

a stack of face shields within the container such that the eye shield portions are in a bent configuration over the raised central portion of the container; and means for applying a fanning force to the plurality of face shields such that the eye shield portions are held in a semi-rigid, separated condition so that abrasion of the eye shield portions is minimized.

13. The package of claim 12 wherein the raised central portion comprises an inverted V.

14. The package of claim 12 wherein the face shield comprises a surgical face mask material attached to the eye shield portion.

15. The package of claim 14 wherein the face shield further comprises attachment means attached thereto adapted to position the face shield around the head of a wearer, and further wherein the raised central portion comprises a cut-out adapted to position the attachment means below the raised central portion.

16. The package of claim 15 wherein the attachment means are selected from a group comprising tie strings, elastic bands or ear loops.

17. A package for retaining and dispensing a plurality of face shields each comprising a flexible, substantially transparent, abrasion-sensitive eye shield portions, the package comprising:

a container having a major and a minor axis and a bottom comprising a raised central portion with an apex along a line parallel to a minor axis of the container; and a plurality of face shields stacked within the container so that the eye shield portions are in a bent configuration over the raised central portion of the container, each eye shield portion being held in a semi-rigid, separated condition so that abrasion of the eye shield portions is minimized.

18. The package of claim 17 wherein the container comprises side walls for apply a compressive force to maintain the eye shield portions in the bent configuration.

19. The package of claim 17 wherein the raised central portion comprises an inverted V.

20. The package of claim 17 wherein the face shield comprises a surgical face mask material attached to the eye shield portion.

21. The package of claim 20 wherein the face shield further comprises attachment means attached thereto adapted to position the face shield around the head of a wearer, and further wherein the raised central portion comprises a cut-out adapted to position the attachment means below the raised central portion.

22. The package of claim 21 wherein the attachment means are selected from a group comprising tie strings, elastic bands or ear loops.

* * * * *

UNITED STATES PATENT AND TRADEMARK OFFICE

CERTIFICATE OF CORRECTION

PATENT NO. : 5,615,767

DATED : April 1, 1997

INVENTOR(S) : Patricia A. Eull, Todd R. Berger and Joel S. Graf

It is certified that error appears in the above-indentified patent and that said Letters Patent is hereby corrected as shown below:

Col. 1, line 25, "PCT Application PCT/US89/01629 (Russell)" should read –PCT Publication No. WO 89/10106 (Russell)--

Signed and Sealed this

Seventh Day of July, 1998

Bruce Lehman

*Attest:*

BRUCE LEHMAN

*Attesting Officer*

*Commissioner of Patents and Trademarks*